US011767646B2

(12) United States Patent
Dusault

(10) Patent No.: US 11,767,646 B2
(45) Date of Patent: Sep. 26, 2023

(54) SYSTEMS AND METHODS FOR SPANNING STRUCTURES

(71) Applicant: Allen J. Dusault, Libertyville, IL (US)

(72) Inventor: Allen J. Dusault, Libertyville, IL (US)

( * ) Notice: Subject to any disclaimer, the term of this patent is extended or adjusted under 35 U.S.C. 154(b) by 90 days.

(21) Appl. No.: 17/559,838

(22) Filed: Dec. 22, 2021

(65) Prior Publication Data

US 2022/0205197 A1 Jun. 30, 2022

Related U.S. Application Data

(60) Provisional application No. 63/131,183, filed on Dec. 28, 2020.

(51) Int. Cl.
*E01D 11/02* (2006.01)
*E01D 19/14* (2006.01)
*E01D 19/16* (2006.01)

(52) U.S. Cl.
CPC ..... *E01D 11/02* (2013.01); *E01D 19/14* (2013.01); *E01D 19/16* (2013.01)

(58) Field of Classification Search
CPC ..... E01D 11/00; E01D 11/02; E01D 11/04; E01D 19/14; E01D 19/16
See application file for complete search history.

(56) References Cited

U.S. PATENT DOCUMENTS 245,034 A * 8/1881 Bayer ..... E01D 11/02 14/19
605,153 A * 6/1898 Waddell ..... E01D 11/02 14/19
1,235,627 A * 8/1917 Woodward ..... E01D 11/02 14/19
2,413,019 A * 12/1946 Wolfard ..... E01D 11/02 14/19
2,433,878 A * 1/1948 Wolfard ..... E01D 11/00 14/19
3,604,361 A * 9/1971 Harbert ..... E01B 25/16 104/123

(Continued)

FOREIGN PATENT DOCUMENTS

JP 06341110 A * 12/1994

*Primary Examiner* — Abigail A Risic
(74) *Attorney, Agent, or Firm* — McAndrews, Held & Malloy, Ltd.

(57) ABSTRACT

A structural spanning system that may be embodied by a cable array bridge system, which typically includes a pair of inclined towers separated by a horizontal distance spanned by a bridge deck and oriented at an outward angle. On opposing ends of the central bridge deck, the towers, and/or columns are secured at a common fulcrum. The columns are similarly oriented at an angle relative to a horizontal plane between fulcrums. Upper cables between towers extend to the deck and create a perpendicular force vector where they connect and are tensioned across the shallow arch bridge deck. Lower cables extend between opposing inclined columns, with one or more stringer cables extending between the lower cables and the bridge deck. Securing the lower cables to the deck via the stringer cables stabilizes the deck in tension by a counterforce to the upper cables. As a result, the bridge deck experiences a balanced pre-stress of upper cable forces in tension through the network of cables.

20 Claims, 17 Drawing Sheets

(56) References Cited

U.S. PATENT DOCUMENTS

| | | | | | |
|---|---|---|---|---|---|
| 4,223,495 | A * | 9/1980 | Peter | E04C 3/10 | 52/87 |
| 5,060,332 | A * | 10/1991 | Webster | E01D 11/04 | 14/20 |
| 5,241,721 | A * | 9/1993 | Muller | E01D 11/04 | 14/22 |
| 5,325,557 | A * | 7/1994 | Penuela | E01D 19/14 | 14/2.4 |
| 6,012,191 | A * | 1/2000 | Caldwell | E01D 19/14 | 14/18 |
| 2003/0150071 | A1* | 8/2003 | Royer | E01D 4/00 | 14/18 |
| 2008/0313825 | A1* | 12/2008 | Murakoshi | E01D 11/00 | 14/19 |

* cited by examiner

SYSTEMS AND METHODS FOR SPANNING STRUCTURES

CROSS REFERENCE TO RELATED APPLICATIONS

This application is a Non-Provisional patent application of U.S. Provisional Patent Application No. 63/131,183 entitled "Systems And Methods For Spanning Structures" filed Dec. 28, 2020, which is herein incorporated by reference in its entirety.

BACKGROUND

This disclosure is directed to a series of structural spanning concepts which address real-world physical infrastructure inefficiencies in bridge or transportation engineering technologies, as well as other spanning or load-bearing applications.

Typically, more than 75% of a bridge's mass is used to support the bridge's weight, rather than vehicles, people, and/or objects crossing the bridge. This is due, in part, to the axiom in structural engineering technologies that large, structural elements and bearings are needed to support dead loads (e.g., columns and beams) as well as live loads (e.g., people and vehicles). The resulting implication insists that large and typically heavy structural components are required to safely carry heavy vertical loads and to mitigate wind, seismic, and/or other forces acting on the bridge. Such large structural components require substantial material consumption, carbon penalties, and other potential environmental, economic, and social costs. Accordingly, systems and methods for improving structural spanning systems, such as bridges, by providing support without the large structural components required in conventional systems, is beneficial.

Further limitations and disadvantages of conventional and traditional approaches will become apparent to one of skill in the art, through comparison of such systems with the present disclosure as set forth in the remainder of the present application with reference to the several drawings.

SUMMARY

The present disclosure relates to structural spanning concepts that may be embodied by a bridge employing one or more cable arrays and load reintroduction system. More particularly, this disclosure is directed to an arrangement of structural components, tensioned via a network of cables, to redistribute forces from loads acting on the bridge, by reintroducing those loads at ends of the bridge deck (e.g., at one or more fulcrums) as eccentric loads. Reintroduction of such eccentric loads creates a negative bending moment across the deck span, thereby supporting loads on the bridge.

Advantageously, the disclosed bridge system does not rely on a catenary cable. Rather, the disclosed bridge system provides multiple pathways to distribute force, including an array of upper, lower, and vertical cables, as well as reintroducing eccentric loads into the bridge deck, creating a typically shallow camber at the bridge deck. Structural components of the bridge system transfer the forces through a fulcrum, thereby ensuring efficient distribution of forces while providing flexibility in response to applied loads. Further, such a bridge can typically be erected more rapidly, such as from a single point of anchorage.

BRIEF DESCRIPTION OF THE DRAWINGS

These and other features, aspects, and advantages of the present disclosure will become better understood when the following detailed description is read with reference to the accompanying drawings of several examples in which like characters represent like parts throughout the drawings, wherein.

The figures are not necessarily to scale. Where appropriate, similar or identical reference numbers are used to refer to similar or identical components.

DESCRIPTION

Figure 1A:
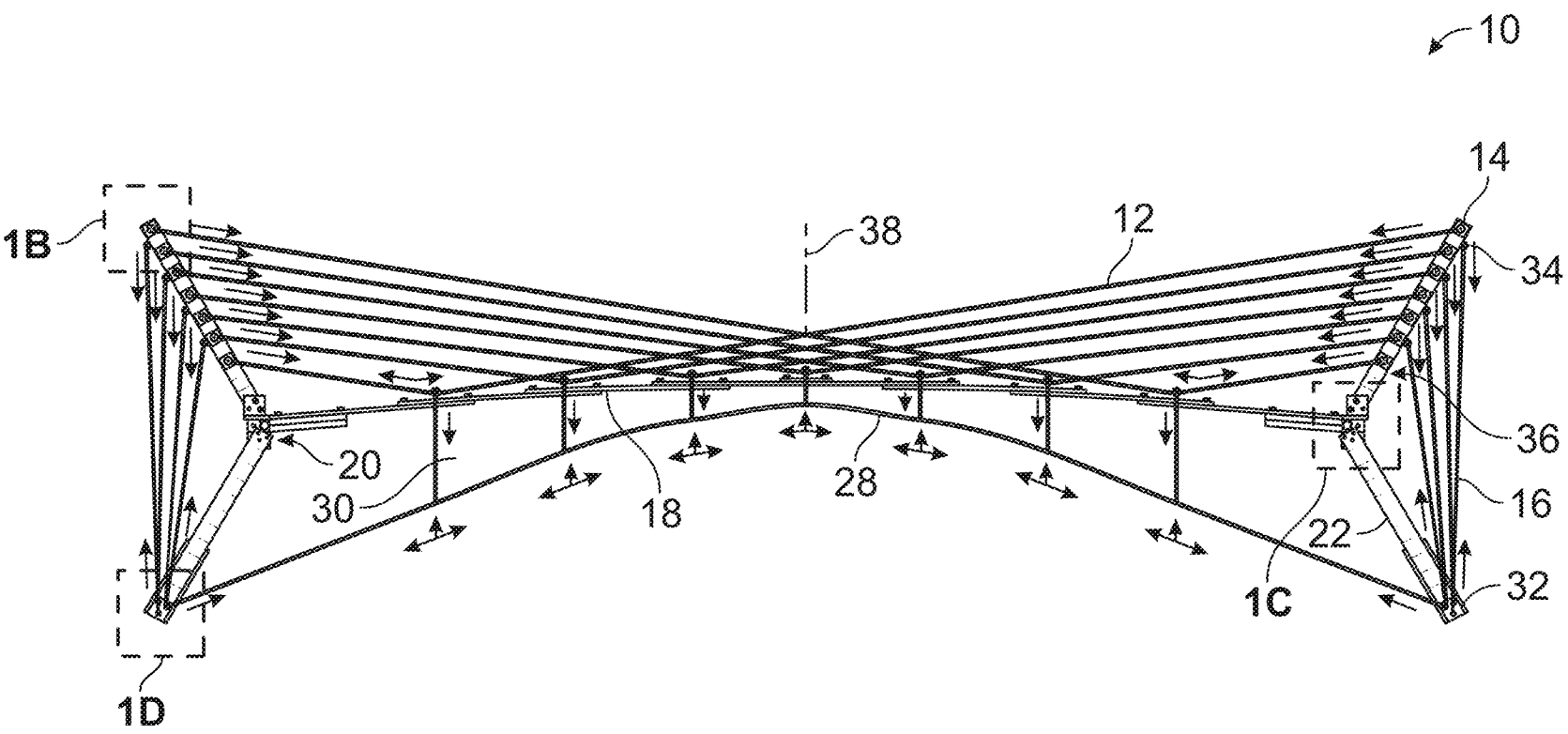
FIG. 1A illustrates a side view of an example bridge system, in accordance with aspects of this disclosure.

Certain embodiments of the disclosure relate to improved structural spanning systems. In particular, structural spanning systems such as suspension bridges encompass a range of applications, from footbridges to road bridges, but may also be applicable to other spanning systems such as building floors, catwalks, and roofs, among others. These concepts apply to structural elements of spanning systems, inclusive of beams and girders.

Conventional suspension bridges may consist of two or more towers mounted on opposing sides of an obstacle (e.g., a river, gorge, roadway, etc.), with a main catenary cable spanned between them, and some sort of pathway suspended from the catenary cable.

Some such bridges may be equipped with vertical suspenders to support the roadway from the main catenary cable. In such a bridge, the roadway follows the catenary cable. Cable stayed bridges, while not relying on catenary cables, work under a similar principle of carrying bridge deck loads to towers that transfer those loads in compression downward to the foundation.

Conventional bridge spanning technologies are designed to transfer both live (e.g., dynamic or applied) and dead (e.g., static or self-weight) gravitational loads from span member(s), to supporting element(s) (e.g., columns, walls, piers, etc.), to the ground or foundation upon which the bridge is supported. Regardless of type of load (e.g., snow on a roof, trucks on a bridge deck, etc.), conventional structures are engineered to transfer gravity loads to the ground as directly as possible. However, application of this novel bridge design reintroduces those loads back into the bridge superstructure (e.g., a cambered bridge deck in this embodiment).

By contrast to conventional suspension bridges, the disclosed spanning system instead advantageously flips the direction of the vertical and horizontal loads with the intent and effect of reducing or removing those loads through one or more supporting elements. As a result, the disclosed spanning system experiences improved structural strengthening and stiffening for each application of the disclosed concepts. This is achieved by taking advantage of an unusual coupling of gravitational and/or mechanical forces, including the lever principal. The resulting mechanical advantage is realized by converting downwardly directed gravity loads (e.g., from vehicles, as well as forces from weight of structural components such as bridge decks) to an upward "push" through one or more structural spanning components.

For example, vertical bending loads impinging on a span are directed back to one or more structural component(s), thereby generating a neutral or negative bending moment across the span. In other words, forces from weight of the bridge deck and/or the applied vertical loads are redirected to cause the bridge span to bend-up instead of bending down. As a result, a load balancing effect is achieved, which allows for a significant reduction in both the size and the weight of the span's structural component(s).

Conventional technologies have been employed to reduce size and mass of bridge structural elements with limited success. One method is to use "pre-stress," defined as application of a calculated force or moment to structural component(s) in such a manner that the combined internal stresses in a given structural component cancels. Forces resulting from the pre-stress application, in anticipation of applied external loading, may be reduced in such a way that allows for greater loading than would be possible without pre-stressing. One such technique is to embed steel tendons or cables in concrete beams or girders, and tensioning the cables to hold the concrete in compression below a neutral axis (e.g., a middle plane of the beam), and induce tension above the neutral axis. The technique serves to counteract deflection from vertical loading on structural component(s), allowing for greater loads support for a given dimension (e.g., a depth of a beam or girder, etc.), or a reduction in the amount of structural material needed to support a similar load.

Pre-stress designs have also been applied to steel beams and girders to reduce material requirements in bridge applications. Other example bridges employ post-tensioning techniques that apply a tension force to embedded steel tendons after the concrete hardens to strengthen it against loading. Some applications employ post-tensioning steel girders as a retrofit to increase load capacity of existing steel bridges. Post-tensioning techniques are, however, not widely employed in steel (and/or other metals or structural materials) beams and girders.

In disclosed examples, the entire structure advantageously applies pre-stress forces to and across the bridge span, including structural elements such as towers and columns (i.e. legs). This is effected by a fundamental reinterpretation of the pre-stress concept in order to optimize force transfer across a greater part of the entire bridge structure, which is different from conventional pre-stressed concrete structural components, which are themselves pre-stressed as discrete elements. This load balancing effect can also be amplified through the use of cables, levers, and/or other mechanisms by applying additional pre-stress components to the span. Such components can be calibrated (e.g., by material selection, manufacturing process, load bearing properties, arrangement in the bridge structure, etc.) to optimize structural performance. The result is a spanning system(s) (e.g., for long and/or short span transport bridges) with greater structural efficiency (thereby reducing bridge mass and bulk) while maintaining or enhancing desirable engineering properties of structural stiffness and stability.

One such application for the disclosed improved spanning technology is as a substitute for suspension bridge. A conventional suspension bridge, such as the Golden Gate Bridge in San Francisco, Calif., serves as an archetype. A suspension bridge typically consist of least two towers, a horizontal bridge deck running from one side of the area spanned to the other side, cables that run from the bridge deck over the towers (typically forming a parabolic shape) to an anchorage on either end of the bridge, vertical suspenders that run from the larger cables down to the bridge deck, and a supporting foundation for each of the towers where the loads transfer to the ground. In a suspension bridge, loads on the bridge deck (both live and dead loads) are captured in tension by the large cables and/or attached suspenders or hangers.

Tension forces acting on a conventional bridge are directed to each of the towers and through the anchorages.

The cables draping over the towers transfer the deck loads to compression loading of the towers and to the foundation. The more load on the bridge deck, the more force on the cabling, and the greater compressive load that runs from the top of each tower to the foundation. The anchorages, which are typically constructed from concrete, hold the cable forces in tension. The bridge may also be subjected to other loads, such as wind forces, that create swaying motions if the bridge deck is not stabilized (e.g., with a truss as on the Golden Gate Bridge) and/or otherwise stiffened or modified to reduce wind loads. Regardless of some variation on the example archetype, conventional suspension bridges work largely as described.

The disclosed bridge spanning system according to the present invention works differently from conventional suspension bridges and other similar bridge archetypes in fundamental ways. For example, towers and supporting columns (or legs) are not vertically oriented, as is the case in conventional bridges. The supporting towers and/or columns are instead oriented at an angle. Arranging the supporting columns at an angle allows loads to be reintroduced back into the structure. The towers and legs are therefore used as a kind of lever, such that the towers and columns are hinged at their nexus with the bridge deck. A compressive load that is applied to the towers and/or columns, and serves as a pre-stress force, comes in part from the live and dead load on the deck itself.

In disclosed examples, a bridge system configured to recycle loads on the bridge deck or superstructure though one or more structural elements, the bridge comprising: first and second towers separated by a horizontal distance; first and second columns each hinged to the first and second towers, respectively, at first and second fulcrums, respectively; a bridge deck extending between the first and second fulcrums and secured thereto; a plurality of upper cables each and extending between the towers and the bridge deck; one or more lower cables extending between the first and second columns; one or more stringer cables extending between the one or more lower cables and the bridge deck and secured thereto; and one or more vertical cables extending between the first tower and the first column.

In some examples, a first upper cable of the plurality of upper cables extends from a first tower fastener of the first tower to a first deck fastener arranged at a first portion of the bridge deck beyond a midpoint between the first and second fulcrums.

In some examples, a second upper cable of the plurality of upper cables extends from the first deck fastener to a second tower fastener of the second tower.

In some examples, the first tower further comprises a third tower fastener arranged below the first tower fastener along a length of the first tower, wherein a third upper cable of the plurality of upper cables extends from the third tower fastener to a second deck fastener of the one or more deck fasteners arranged at a second portion of the deck at or before the midpoint.

In some examples, a fourth upper cable of the plurality of upper cables extends from the second deck fastener to a fourth tower fastener of the second tower. In examples, the fourth tower fastener is arranged above the second tower fastener along a length of the second tower.

In some examples, the one or more stringer cables are shortest at the midpoint and longest proximate the fulcrum.

In some examples, one or more stringer fasteners to secure the one or more stringers to the bridge deck or the one or more lower cables. In examples, one or more vertical tower fasteners arranged along a length of the first tower to tension the one or more vertical cables to one or more column fasteners of the first column. In some examples, one or more vertical tower fasteners arranged along a length of the second tower to tension the one or more vertical cables to one or more column fasteners of the second column.

In some examples, the first and second columns are anchored to a foundation or a fixed structure. In examples, the first and second columns are anchored to the fixed structure via a hinged foundation connection. In examples, the fixed structure is one of a geological structure, an embankment, a roadway, another bridge, concrete foundation, or a building.

In some examples, each fulcrum comprises a deformable or pivoting structure configured to compress or rotate in response to a force applied to the suspension bridge. In examples, the deformable structure comprises a rubber material or a pivoting structure comprised of solid non deforming material. In examples, the deformable structure is formed as a generally cylindrical tube or a solid pivoting structure that provides for rotation. In examples, one or more of the bridge deck, the first or second towers, the first or second columns, or a combination thereof, are secured to the fulcrum via one or more hinges or functionally similar mechanisms that allow for movement.

In some examples, the first or second towers is oriented at obtuse angle relative to a horizontal plane between the first and second fulcrums.

In some examples, the first or second columns is oriented at obtuse angle relative to a horizontal plane between the first and second fulcrums.

In some examples, the bridge deck comprises a plurality of deck plates, each plate overlapping an adjacent deck plate along a length of the bridge deck between the first and second fulcrums. In examples, a surface is typically overlayed on top of the bridge deck to support traffic.

In some examples, an approach extending from a portion of the foundation to the bridge deck. In examples, the approach is configured to shift into or away from the bridge deck in response to motion of the bridge.

In some examples, one or more of the tower fasteners, deck fasteners, column fasteners, or stinger fasteners is a bolt, an eyebolt ring, a screw, a rivet, a welded joint, a pulley, or a combination thereof.

In some examples, the bridge is comprised of a wooden material.

In some examples, the bridge is comprised of a metallic material. In examples, the bridge is comprised of aluminum or steel.

In some examples, the bridge is comprised of a composite material or concrete in a range of compositions and reinforcements.

In some disclosed examples, a bridge system configured to recycle loads on the bridge deck or superstructure though one or more structural elements, the bridge including: first and second towers separated by a horizontal distance; first and second columns each hinged to the first and second towers, respectively, at first and second fulcrums, respectively; a plurality of upper cables each and extending between the towers and the bridge deck; a bridge deck extending between the first and second fulcrums and secured thereto; and one or more vertical cables extending between the first tower and the first column.

In some examples, one or more lower cables extending between the first and second columns; and one or more stringer cables extending between the one or more lower cables and the bridge deck and secured thereto.

As used herein, the terms "first" and "second" may be used to enumerate different components or elements of the same type, and do not necessarily imply any particular order.

As used herein, the terms "coupled," "coupled to," "coupled with," "joined," "fixed," "secured," "fastened," or similar terms each mean a structural connection, whether attached, affixed, connected, joined, fastened, linked, and/or otherwise secured. As used herein, the term "attach" means to affix, couple, connect, join, fasten, link, and/or otherwise secure. As used herein, the term "connect" means to attach, affix, couple, join, fasten, link, and/or otherwise secure.

As used herein, the term "fastener," "mount," or similar terms each encompass but are not limited to a bolt, an eyebolt ring, a screw, a rivet, a weld joint, a pulley, or a combination thereof.

Turning now to the drawings, FIG. 1A depicts a side view of a bridge system 10 in accordance with the spanning technologies of the present disclosure. As shown, bridge 10 includes a pair of towers 14 separated by a horizontal distance spanned by a bridge deck 18. On opposing ends of the bridge deck 18, each of the bridge deck 18, the towers 14, and/or columns 22 are secured at a common nexus or fulcrum 20. Tension on the bridge deck 18 from an array of upper cables 12 forms a shallow arch with a vertical or upward camber at a midpoint 38. For example, cables of the upper cable array 12 are secured to one or more tower fasteners 36, and extend out over the bridge deck 18, secured to the bridge deck 18 at one or more bridge fasteners 40.

In some examples, the tension forces in each of the cables are transferred to the towers 14. One or more vertical cables 16 on the opposing side of the towers are tensioned and/or anchored into a foundation at the base of the columns 22. The combined compressive forces on the towers 14 from each set of vertical and upper bridge deck cables are then reintroduced into the bridge deck 18 at each fulcrum 20. That combined compressive load generates rotation at the fulcrum which causes a horizontal force vector creating an eccentric load on the central bridge deck at midpoint 38, inducing vertical upward camber.

One or more lower cables 28 extends between opposing columns 22, secured to each column at a column fastener 42, which may be collocated with a foundation anchor 32. In the example of FIG. 1A, one or more stringer cables 30 extend between the lower cables 28 and the bridge deck 18, and are secured to the bridge deck 18 via one or more stringer fasteners 40. In some examples, the stringers 30 are fixed to the lower cable 28 via one or more fasteners 46. As shown, securing the lower cable(s) 28 the deck 18 via the one or more stringer cables 30 stabilizes the deck in tension by providing a counterforce to the cables of upper cable array 12. As a result, the bridge deck 18 experiences a balanced and adjustable deck pre-stress, or "storing" of upper cable forces in tension through the network of cables.

The one or more vertical cables 16 extend between each tower 14 and each column 22. For example, a vertical cable fastener 44 may tension the vertical cables 16 between the towers 14 and a fastener at the anchorage 32 (such as fastener 42 or other suitable fastener).

As shown in the example of FIG. 1A, the towers 14 are oriented at an angle (e.g., an obtuse angle) relative to a horizontal plane between the first and second fulcrums. The columns 22 are similarly oriented at obtuse angle relative to the horizontal plane between the first and second fulcrums. In some examples, an angle measured from the horizontal plane to each towers 14, an angle measured from each tower to the columns 22, and an angle measured from the columns to the horizontal plane are approximately equal, at approximately 120 degrees applying a force to the bridge deck (e.g., at an angle, such as a substantially perpendicular angle relative to the bridge deck and/or a horizontal plane between fulcrums). In some examples, the angles may be different, such as to accommodate a particular application. But the direction of the resulting force is oriented substantially vertically (e.g., upward).

Although illustrated as constructed of multiple similar bridge deck sections, each configured to provide both stiffness and stability for the bridge itself as well as a support surface for traffic, in some examples, the bridge deck is constructed of sections of varying size and/or shape, is constructed from multiple cables upon which a surface is laid, and/or an alternative technique or method for providing a continuous pre-stressed path across the full length of the bridge deck.

As disclosed with respect to the several figures, when a load is applied on the bridge deck 18 (e.g., from passing traffic on the bridge 10 and/or from the weight of the bridge), the forces follow one or more paths: through the upper cable array 12, through the lower cables 28, and/or through the shallow arch of the bridge deck 18.

In response to application of a load on the bridge deck 18, forces are transferred through the upper cable array 12 and to the angled towers 14. Unlike a conventional suspension bridge, however, the forces acting on the upper cable array 12 are able to transfer or couple the load, either through a continuous or a segmented cable through to the vertical cables 16, anchored to a column fastener 42. Thus, the forces are transferred to a foundational structure upon which the columns 22 are anchored via joint or anchorage 32, resulting in a self-anchoring type bridge. The one or more lower cables 28 can traverse the length of the bridge 10, being secured to the anchorage 32 at or near the hinged joint 62.

It would also of course be possible to anchor the columns 22 and/or a structural approach 26 to an existing geological feature 64, such as a rock outcropping, or to secure it to another anchoring structure, such as concrete foundation.

Also illustrated in FIG. 1A are multiple force vectors depicting transference of loads through the various cables (e.g., upper cables 12, vertical cables 16, lower cable(s) 28, stringer cable(s) 30). The interconnection between various joints including, but not limited to, the fulcrum 20.

Figure 1B:
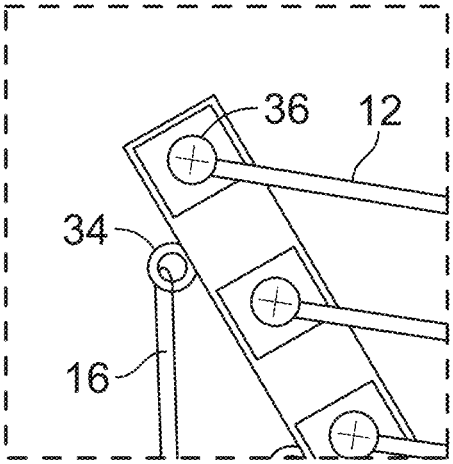
FIG. 1B illustrates a connection detail of the example bridge system shown in FIG. 1A, in accordance with aspects of this disclosure.

FIG. 1B illustrates a detailed view of an example of the top portion of a tower 14. As shown, upper cables 12 are secured to the tower 14 at a tower fastener 36, and vertical cable 16 is secured to the tower 14 at a vertical tower fastener 34.

Figure 1C:
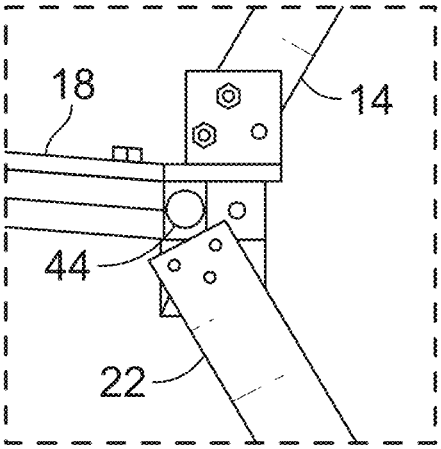
FIG. 1C illustrates another connection detail of the example bridge system shown in FIG. 1A, in accordance with aspects of this disclosure.

FIG. 1C illustrates a detailed view of the example fulcrum 20 (e.g., a support about which a lever turns or a point of connection that allows pivoting or rotation). As shown, a fulcrum element 44 is at a junction between a tower 14, a bridge deck 18, and a column 22. As described in greater detail below, the fulcrum element 44 is a deformable object, able to rotate and/or compress in response to an applied force, yet returns to its desired form upon removal of the load.

Figure 1D:
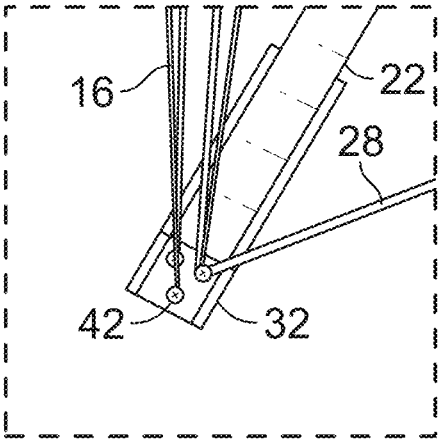
FIG. 1D illustrates yet another connection detail of the example bridge system shown in FIG. 1A, in accordance with aspects of this disclosure.

FIG. 1D illustrates detailed view of the example anchorage 32, as the column 22 terminates at the foundation. As shown, the vertical cable(s) 16 and/or lower cable(s) 28 are secured to the anchorage 32 at one or more column fasteners 42.

Figure 2:
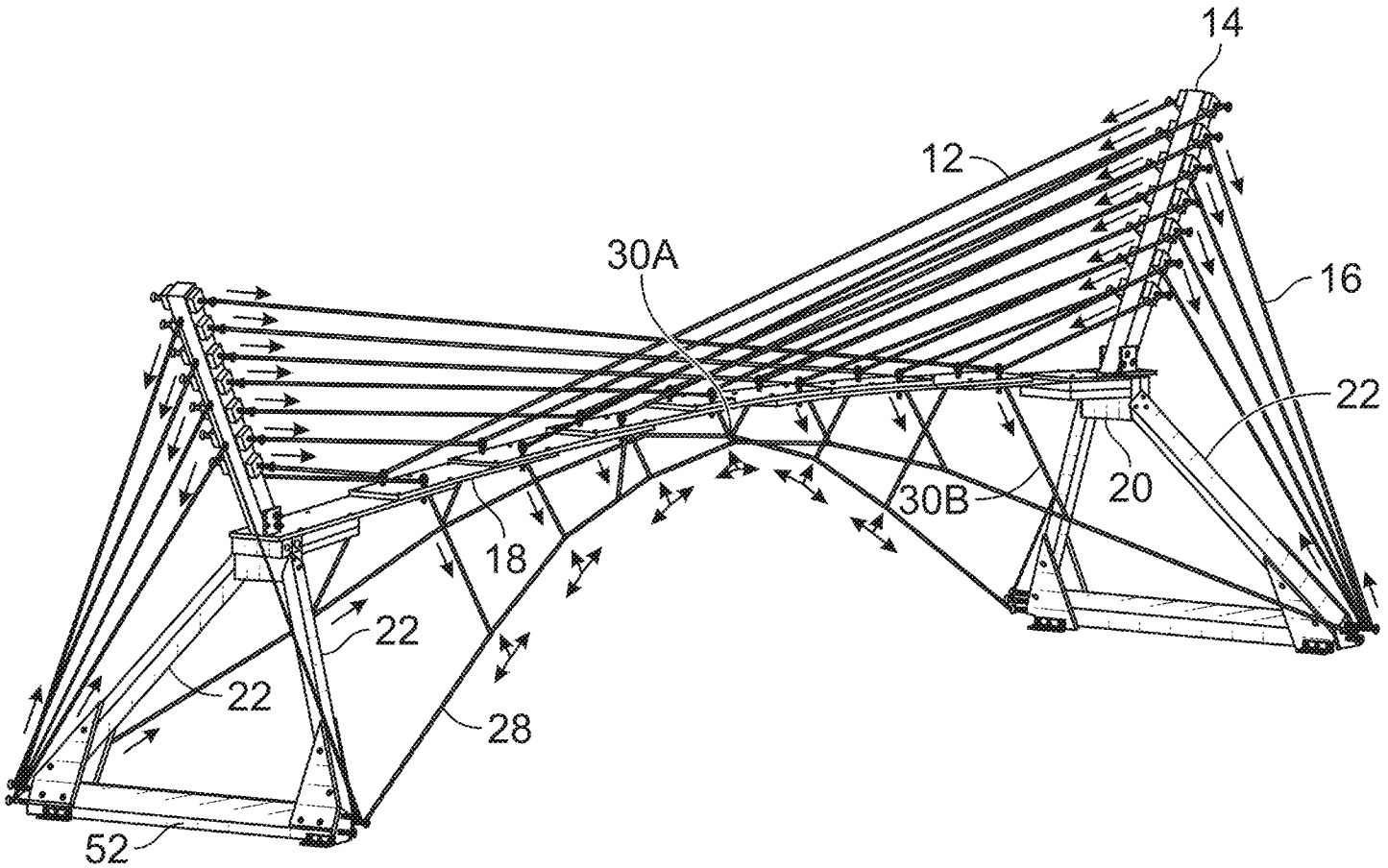
FIG. 2 illustrates a perspective view of the example bridge system shown in FIG. 1A, in accordance with aspects of this disclosure.

FIG. 2 depicts the example bridge 10 in perspective view. Vertical cables 16 connect to each of the towers 14 at one or more vertical tower fasteners 32 and are tensioned vertically to anchor at the base of the columns 22 on either side by one or more anchor or column fasteners 42. As shown, a pair of columns 22 on either side of the bridge deck 14 may extend toward the foundation in a substantially "Y" shape, connected. The supporting columns 22 are optionally braced and/or hinged by one or more girders, supports, and/or cables 52 as they are anchored to a foundation 64 (e.g., a geological structure, an embankment, a concrete foundation, a roadway, another bridge, or a building).

Each column 22 may tension the vertical cables 16 at the column fasteners 42. In some examples, each of the vertical cables 16 is a discrete cable that can be separately tensioned, which can provide redundancy. In some examples, one or more of the vertical cables 16 are continuous (e.g., anchoring a first end of the cable at a column on a first lateral side of the fulcrum 20, threaded through an eyebolt ring at the vertical tower fastener 34, and extending to a second lateral side of the fulcrum 20 to anchor a second end of the vertical cable 16 at the column fastener(s) 42).

In this example, upper cable connections, which may be equally or selectively distributed across one or more overlapping bridge deck sections, are "threaded" through the bridge deck fasteners 40 (e.g., eyebolt rings), attaching at substantially equal angles to impart a vertical force in the upward direction on the deck at each point of connection. Lower cable 28 may attach to the bridge deck 18 at the bridge deck fasteners 40, and/or at a separate fastener below the deck.

In the disclosed example bridge 10 system, forces from deck loads are transferred from the towers 14 and/or columns 22 (e.g., at an angle relative to the horizontal plane between fulcrums 20), and back to the arched deck through the connection at the fulcrum(s) 20.

As a single point connection between various load bearing structures, the fulcrum(s) 20 serve as load transfer mechanisms. The fulcrum(s) 20 may take several forms, including, but not limited to, a pin-type connection, a compressible bearing(s) or surface, a spring mechanism, one or more hinges, or a combination thereof. Further, as disclosed herein, one or more elements may be employed to stabilize the fulcrum 20, such as deformable element 44.

The structure and/or function of the fulcrum(s) 20 allows loads (including added pre-stress forces) on the bridge deck 18 to transfer back into the central bridge deck (e.g., at the midpoint 38) with an opposing counterforce component. In such an example, a small rotation at the fulcrum 20 directs the pre-stress horizontally into the bridge deck 20 as an eccentric load (e.g., due to deck camber) with cable pre-stress forces adjusted to the bridge design load, which also allows for substantial force magnification. As a result, upper surfaces of the bridge deck 18 experiences tension while lower surfaces experiences compression, providing a load-balancing function across the bridge deck 18. Furthermore, force transfer can be distributed and/or integrated throughout the whole of the structural system, mitigating extreme stress moments at locations and/or joints along the bridge.

Angles employed by the upper cable array and the vertical anchoring cables are designed to provide an axial load to the towers 14 (e.g., by forming substantially subtended angles). Where the towers 18 and columns 22 meet the bridge deck, they form a hinge at the fulcrum 20 to redistribute the axial compressive loads on the towers 18 to the angled support columns 22, and into the bridge deck 18 as that nexus rotates into the bridge span. That force transition into the shallow arch deck induces a force deflection that is obverse to vertical loads on the bridge deck 18. Thus, the eccentric loading from either end of the shallow arch deck (e.g., induced by the tower and column horizontal pre-stress loading) creates a negative bending moment across the central span of the bridge deck 18.

The lower cable 28 serves to capture some of that force in tension, limiting upward camber of the bridge deck 18. This arrangement provides two large levers on either end of the bridge deck 18, typically exerting an active load in response to deck loading. Those loads are reintroduced in a direction opposing the lower cables that hold the force on the deck in tension. The amount of pre-stress can be controlled by adjusting the tension on the upper and vertical cables. As the bridge uses a portion of the live and/or dead loading on the bridge deck 18 as internal pre-stress, the result is a load balancing mechanism that also imparts stiffness and stability. Thus, the disclosed bridge system 10 functions as an integrated, stiff and stable, self-anchoring and lightweight bridge spanning system.

In some examples, it is also possible to "lock in" pre-stress forces so the load response is not active, only partially active, and/or can be adjusted for a particular application. For instance, elements of the system can be adjusted for a particular distribution (or reintroduction) of forces for a load balancing effect, such as adjusting tension in one or more cables, adjusting one or more characteristics of the fulcrum to modify load application and/or distribution, adjusting one or more characteristics of the deformable element (e.g., geometry and/or stiffness of the material) in order to orient forces into one or more structural components (e.g., the deck deck), and/or the amount of camber at the deck arch.

In some examples, one or more of these characteristics are adjusted predetermined (e.g., material of the deformable element, determined at the design stage), whereas other characteristics may be adjusted at deployment or during use (e.g., tuning tension on one or more cables).

As shown by the example of FIG. 2, multiple stringer cables are shown spanning the distance between the bridge deck 18 and the lower cable 28. For instance, stringer cable 30A is shortest at the midpoint 38, and stringer cable(s) 30B are longest proximate the fulcrum(s) 20. Although illustrated in several examples as being secured to the bridge deck 18 via the one or more bridge deck fasteners 40, in some examples one or more of the stringer cables 30 are secured to the bridge deck 18 via dedicated stringer fasteners.

Figure 3:
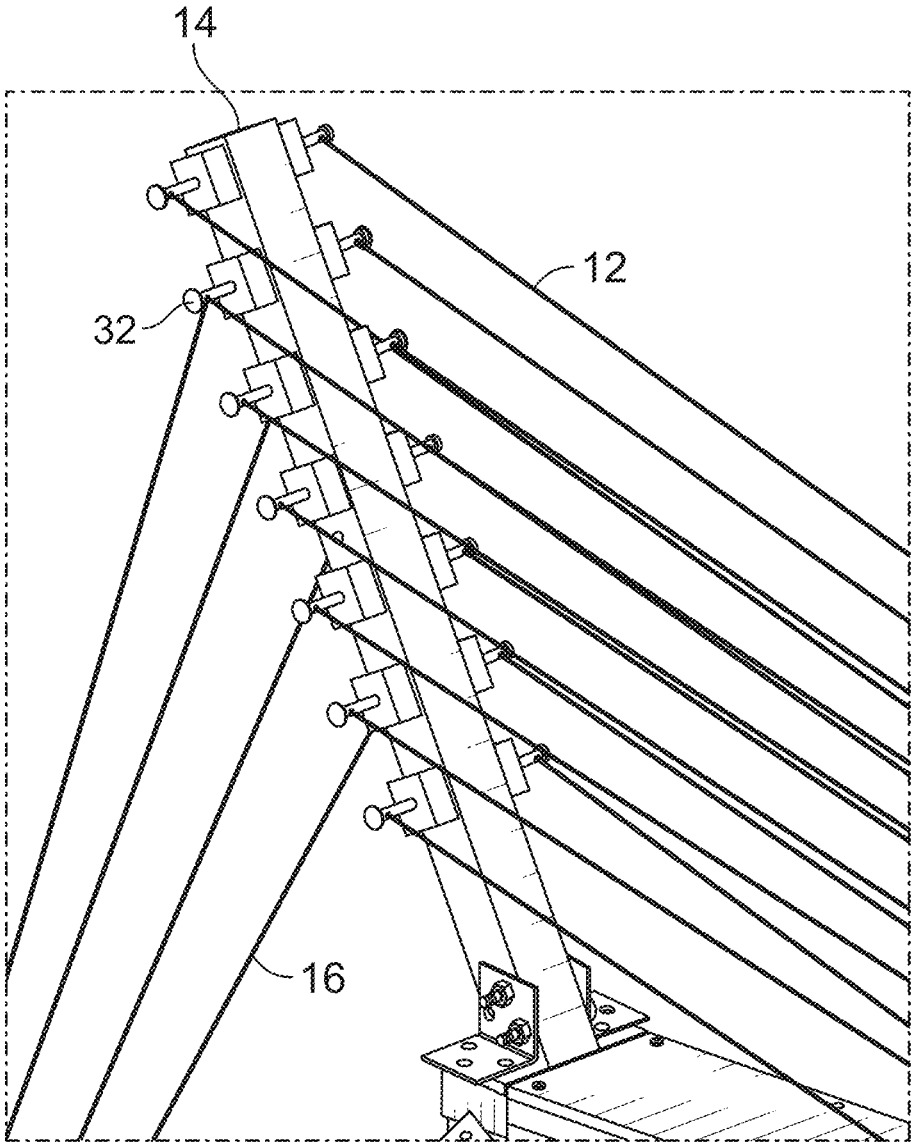
FIG. 3 illustrates an oblique detailed side view of a connection cable arrays for the example bridge system shown in FIG. 1A, in accordance with aspects of this disclosure.
Figure 4:
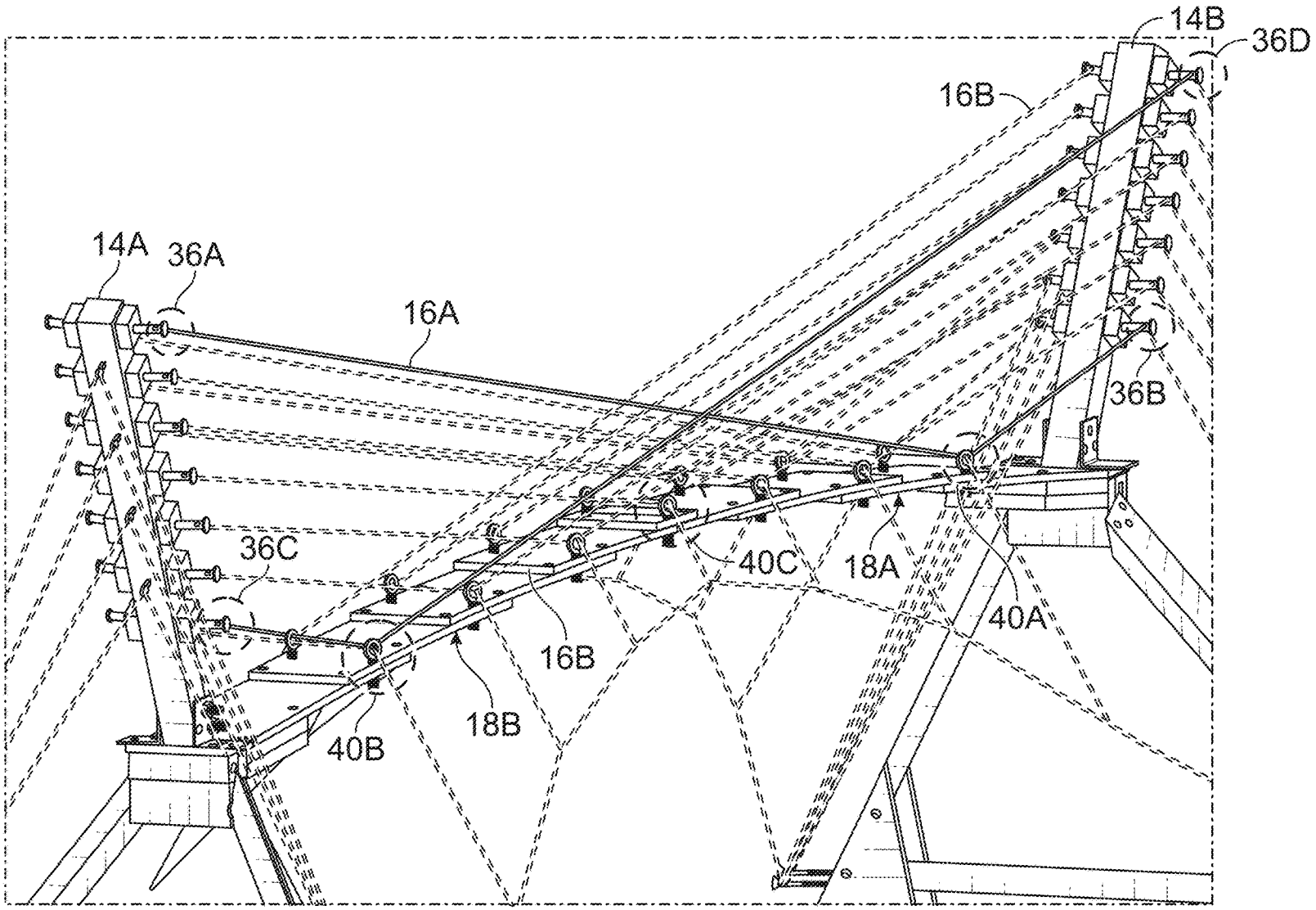
FIG. 4 illustrates a tower detail of the example bridge system shown in FIG. 1A, in accordance with aspects of this disclosure.

FIG. 3 illustrates a detailed perspective view of the example tower 14 from a view from the bridge deck 18. FIG. 4 illustrates a detailed side view of an example arrangement of cable arrays for the example bridge system 10. As shown, a first upper cable 12A of the upper cable array 12 extends from a first tower fastener 36A of a first tower 14A to a first deck fastener 40A arranged at a first bridge deck portion 18A. In this example, the first deck fastener 40A is located beyond a midpoint 38 between first and second fulcrums, which may be collocated with a central deck fastener 40C.

In some examples, the first upper cable 12A extends through the first deck fastener 40A (e.g., an eyebolt ring) and to a second tower fastener 36B of a second tower 14B. In some examples, the first upper cable 12A includes two or more portions which extend from the first and second towers and terminate at the first deck fastener 40A.

The first tower 14A also includes a third tower fastener 36C arranged below the first tower fastener 36A along a length of the first tower 14A. A second upper cable 12B extends from the third tower fastener 36C to a second deck fastener 40B, arranged at a second deck portion 18B at or before the midpoint.

The upper cable 12B then extends from the second deck fastener 40B to a fourth tower fastener 36D arranged above the second tower fastener 36B along a length of the second tower 14B.

Through this cabling arrangement, loading on the bridge is readily transferred between cables and/or structural components of the bridge, and can be adjusted to optimize performance as described herein, providing a more resilient spanning system compared to conventional spanning technologies.

Figure 5:
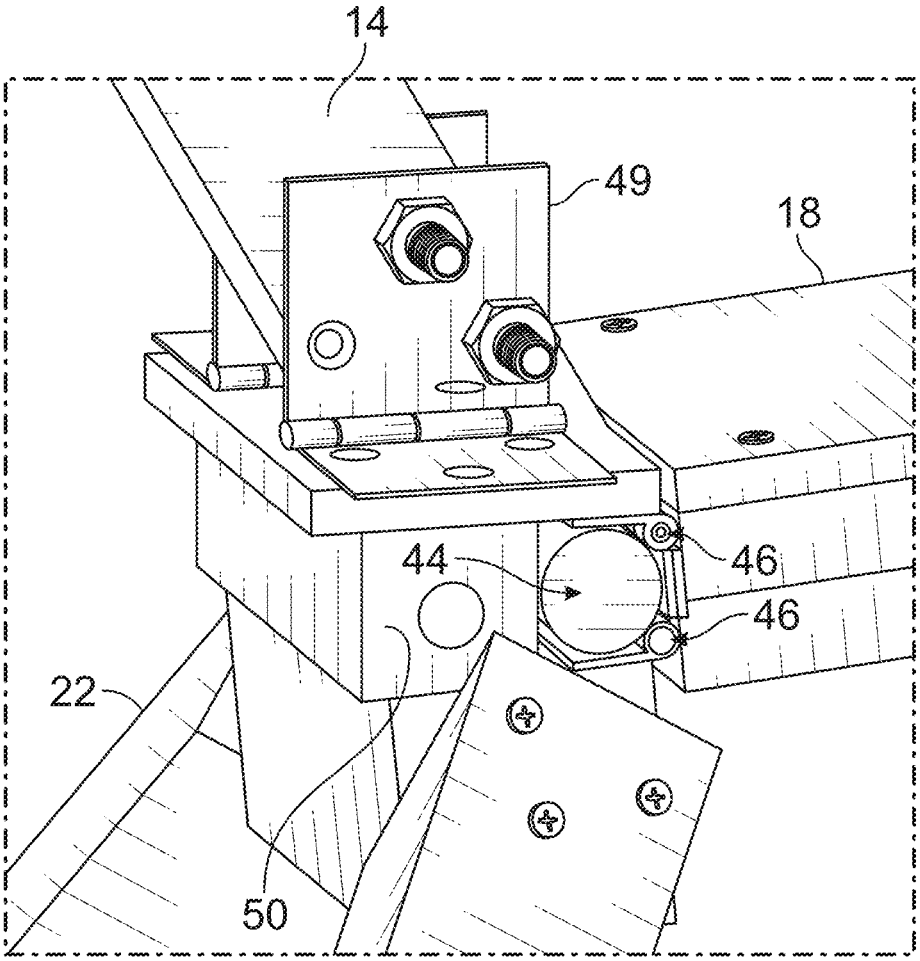
FIG. 5 illustrates a detailed perspective view of an example bridge system shown in FIG. 1A, in accordance with aspects of this disclosure.

FIG. 5 illustrates a detailed perspective view of the example fulcrum 20. In some examples, each fulcrum 20 includes one or more deformable structures 44 configured to compress in response to a force applied to the bridge system 10. In particular, the structure 44 is arranged at an interface between the tower 14, the bridge deck 18, and/or the column 22. As one or more of these components experiences a load, the forces therefrom are transferred through the fulcrum 20, which causes the structure 44 to deform in response. The deformable structure 44 may be constructed of any material suitable for supporting applied loads while providing a dampening effect, inclusive of using materials such as a rubber, plastics, and/or composites. Further, although illustrated as a generally cylindrical tube, the deformable structure 44 may take any particular geometry as needed in a particular application. In some examples, the deformable structure 44 is formed as a single element, whereas in other examples two or more elements are combined to create the structure. In some examples, load transfer at the fulcrum is achieved by means other than a deformable material. For example, one or more solid pin connections can serve a similar purpose, as well as other techniques that induce rotation and/or load transfer at the fulcrum.

In some examples, one or more of the bridge deck 18, the tower 14, the column 22, or a combination thereof, are secured to the fulcrum 20 via one or more hinges. As shown in FIG. 5, the bridge deck 18 is secured to the fulcrum 20 via (opposing) horizontal hinges 46 and 48 oriented perpendicular to the length of the bridge deck 18. The tower 14 is secured to the fulcrum 20 via a pair of (opposing) horizontal hinges 49, oriented in line with the length of the bridge deck 18. In some examples, the hinges are oriented in a similar alignment relative to the length of the bridge deck 18. In some examples, one or more of the hinges are vertically hinged.

Figure 6:
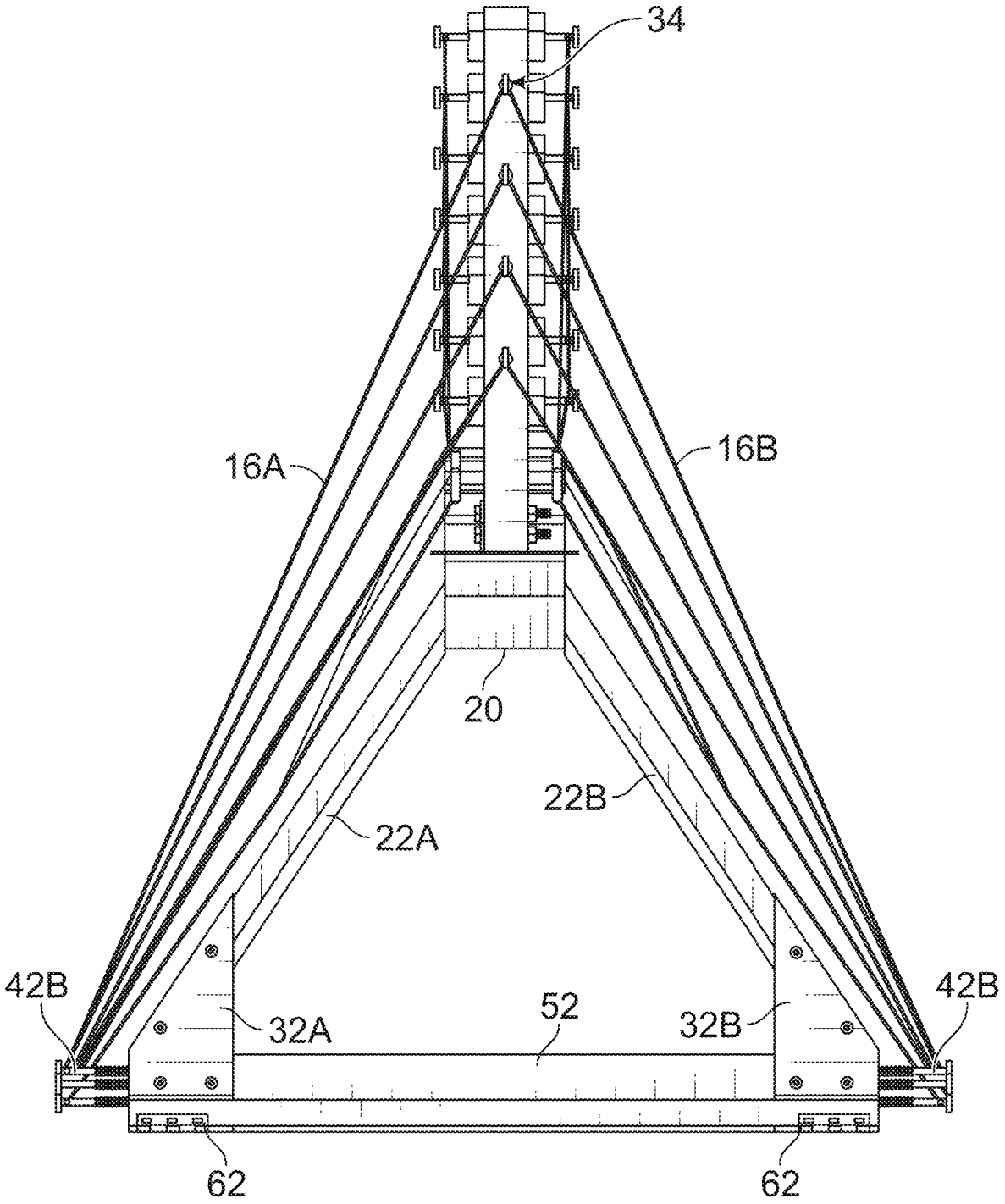
FIG. 6 illustrates a tower and column detailed end view of an example bridge system shown in FIG. 1A, in accordance with aspects of this disclosure.

FIG. 6 illustrates a detailed end view of the example bridge tower 14 and column 22, as viewed from an approach onto the bridge. As shown, the tower 14 includes one or more vertical tower fasteners 34 arranged along a length of the first tower to tension the vertical cables 16 to column fasteners 42 of first and second column(s) 22A and 22B. In particular, the columns 22A and 22B extend downward from the fulcrum 20 at opposing angles to terminate at anchorages 32A and 32B, respectively. As shown, vertical cables 16A and 16B extend downward to be tensioned at column fasteners 42A and 42B, respectively. Although multiple fasteners 42A, 42B are illustrated, in some examples, all vertical cables 16A could be secured to a single fastener 42A, and all vertical cables 16B could be secured to a single fastener 42B. Further, the anchorages 32A and 32B may be joined by one or more girders or supports 52 to stabilize and strengthen the bridge foundation.

Figure 7:
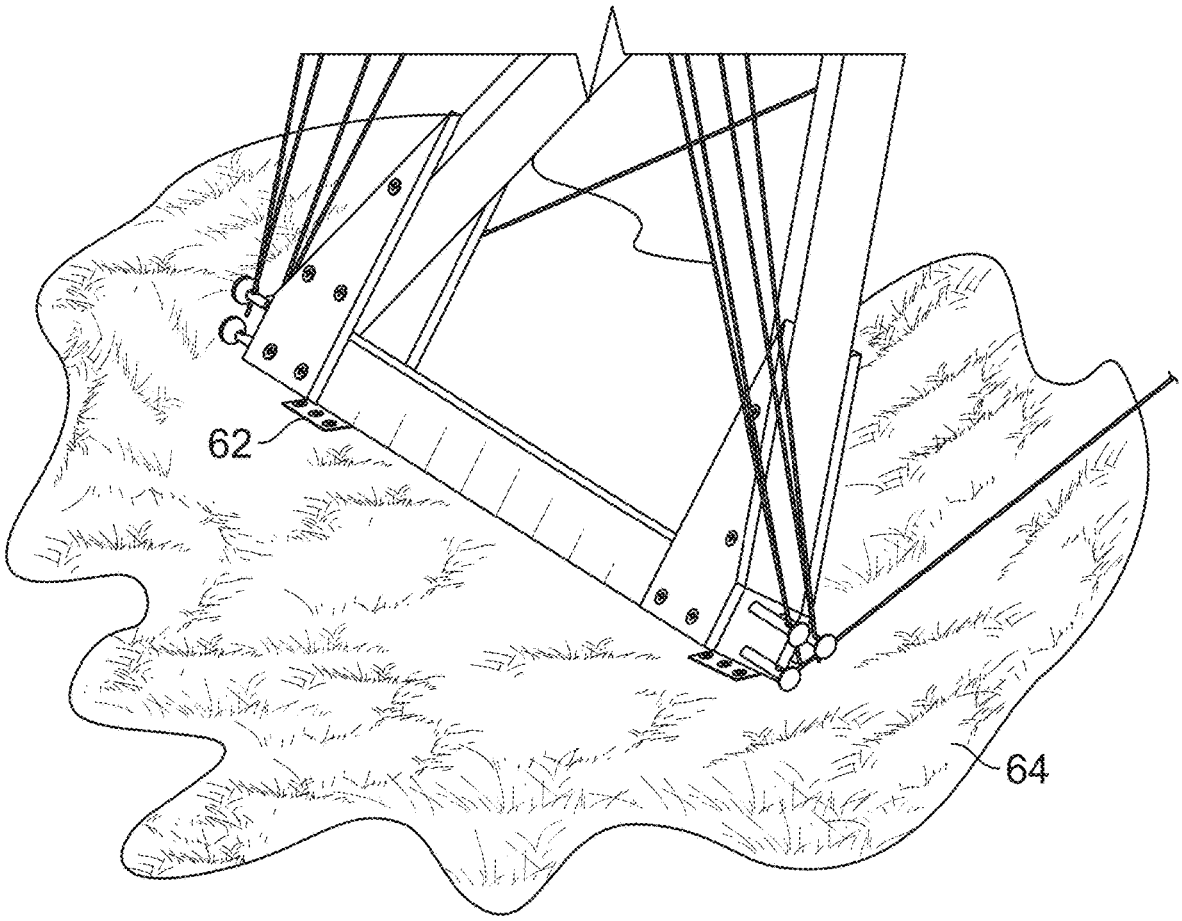
FIG. 7 illustrates a detailed end view of an example bridge system shown in FIG. 1A, in accordance with aspects of this disclosure.
Figure 8:
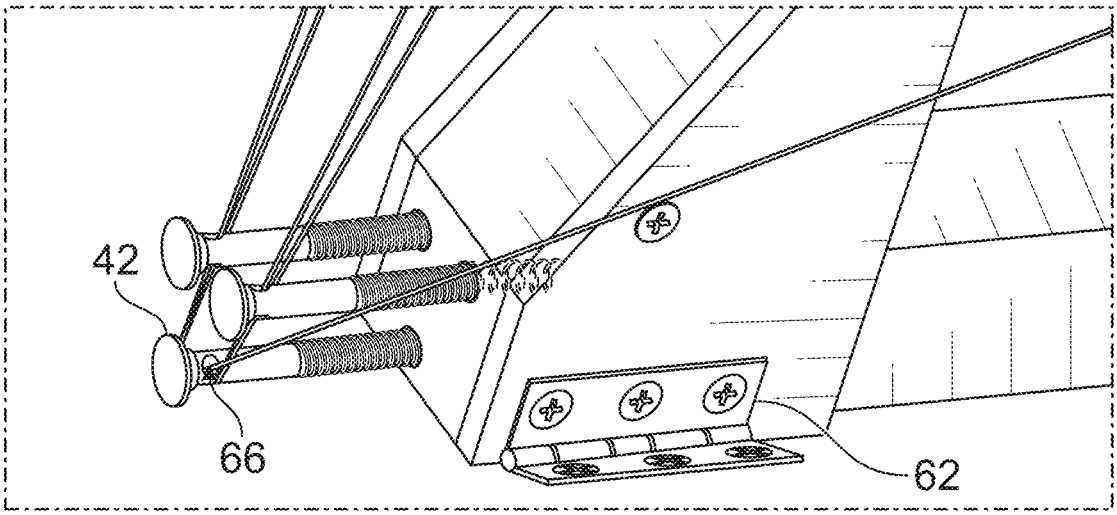
FIG. 8 illustrates an anchorage and column fasteners detailed end view of an example bridge system shown in FIG. 1A, in accordance with aspects of this disclosure.

The first and second columns 22A and 22B are anchored to the fixed structure via a hinged foundation connection 62. Employment of a hinged connection allows for greater flexibility when the bridge 10 is experiencing a load. As is shown in FIG. 7, the anchorage 32 may be secured to a fixed structure or foundation 64, such as a geological structure, an embankment, a roadway, another bridge, or a building, as a list of non-limiting examples. As is further shown in FIG. 8, a fastener 42 may include one or more tensioning mechanisms 66. For example, a cable (e.g., a vertical cable 16) may be threaded through the tensioning mechanism 66 (e.g., a borehole) and the fastener 42 may be turned to wrap the cable about a length of the fastener. In some examples, the cable can be connected to the fastener yet secured to itself (e.g., via a crimp, bolt, etc.), and/or an alternate tensioning mechanism may be employed to secure the cable to the fastener. Although illustrated with respect to column fastener 42, the tensioning mechanisms and/or techniques described with respect to FIG. 8 may be equally applicable to other fasteners disclosed herein.

Figure 9:
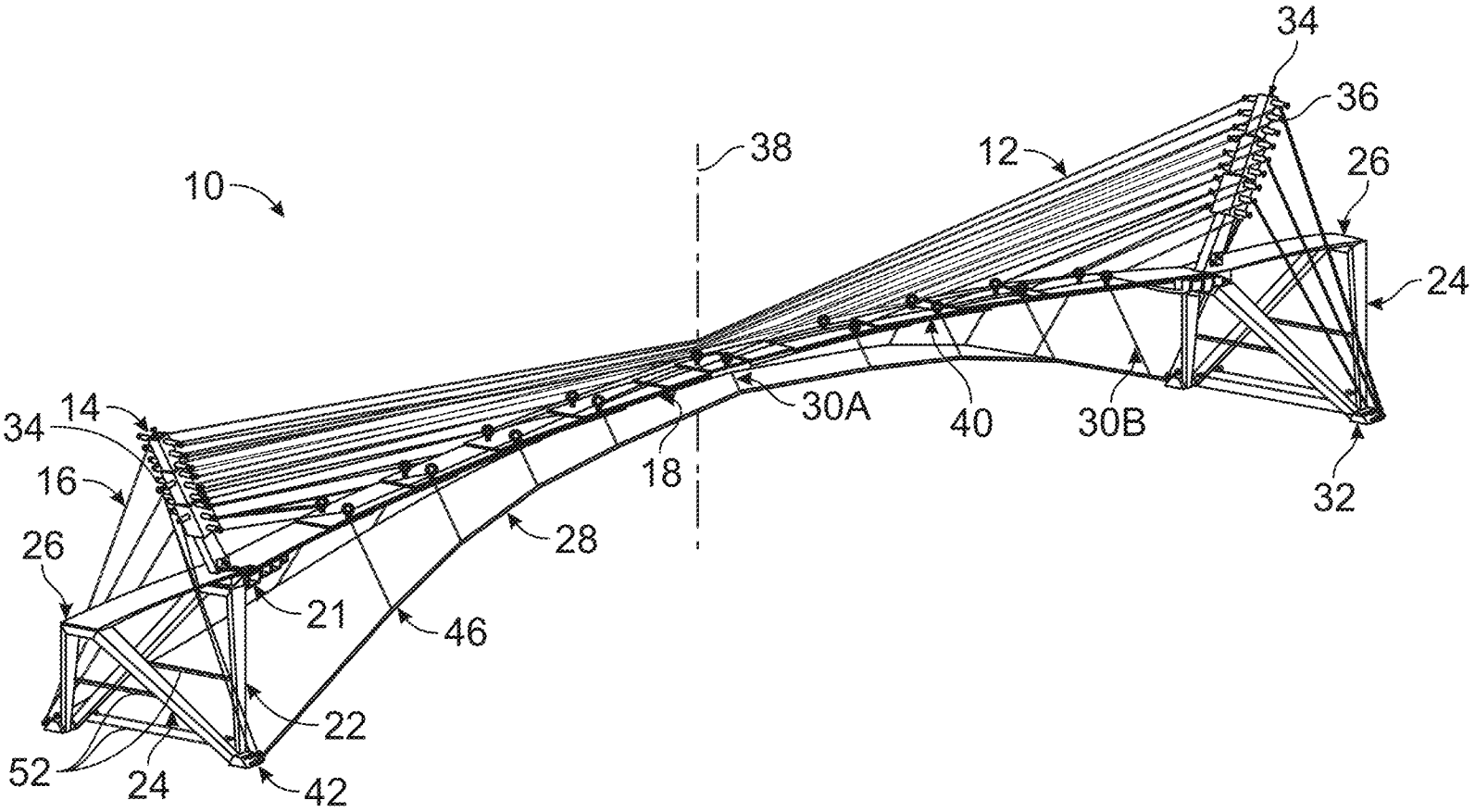
FIG. 9 illustrates a first perspective view of another example bridge system, in accordance with aspects of this disclosure.

FIG. 9 illustrates another example bridge 10, which includes one or more peripheral bridge decks or approaches 26 are incorporated on either end of the arch bridge deck. Although differences between the various figures may exist, where possible, common elements have been labeled with the same reference numeral for clarity. As shown, the approaches 26 serve as a transitional platform from a foundation (e.g., a geological feature, roadway, building, etc.) onto the bridge deck 18. In some examples, the approaches 26 are equipped with a sliding connection onto the bridge deck 18, such that the approaches 26 are not fixed relative to the bridge deck 18 at the fulcrum 20. As the approaches 26 are not fixed, the tower 14 and/or columns 22 act as levers unbound by a fixed approach, allowing rotation about the fulcrum 20 with a horizontal force component, imparting pre-stress into the shallow arch bridge deck.

Figure 10:
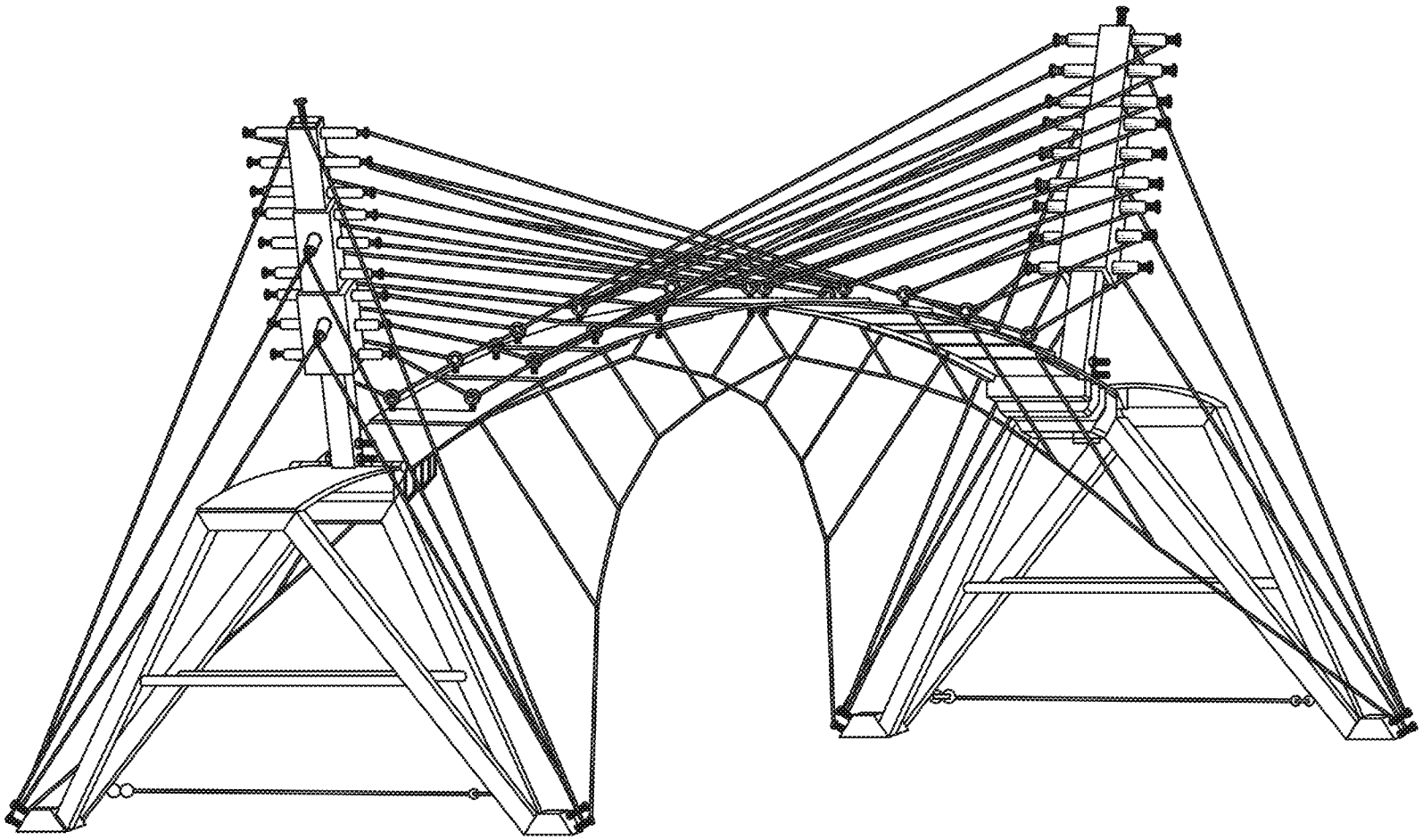
FIG. 10 illustrates a first perspective view of the example bridge system shown in FIG. 9, in accordance with aspects of this disclosure.

In some examples, such as shown in FIG. 10, the approaches 26 are supported by a pier or abutment with one or more rear columns 24, or similar support, on either end as the approaches 26 extends to meet the foundation. In some examples, another cable (not shown) from the top of each tower and extending to an opposing end of the approaches 26 would mitigate undesirable rear column 24 forces (e.g., horizontal "splay" forces) so that the entire length is independently supported, as an alternative to the approaches 26 being anchored to an abutment.

Figure 11:
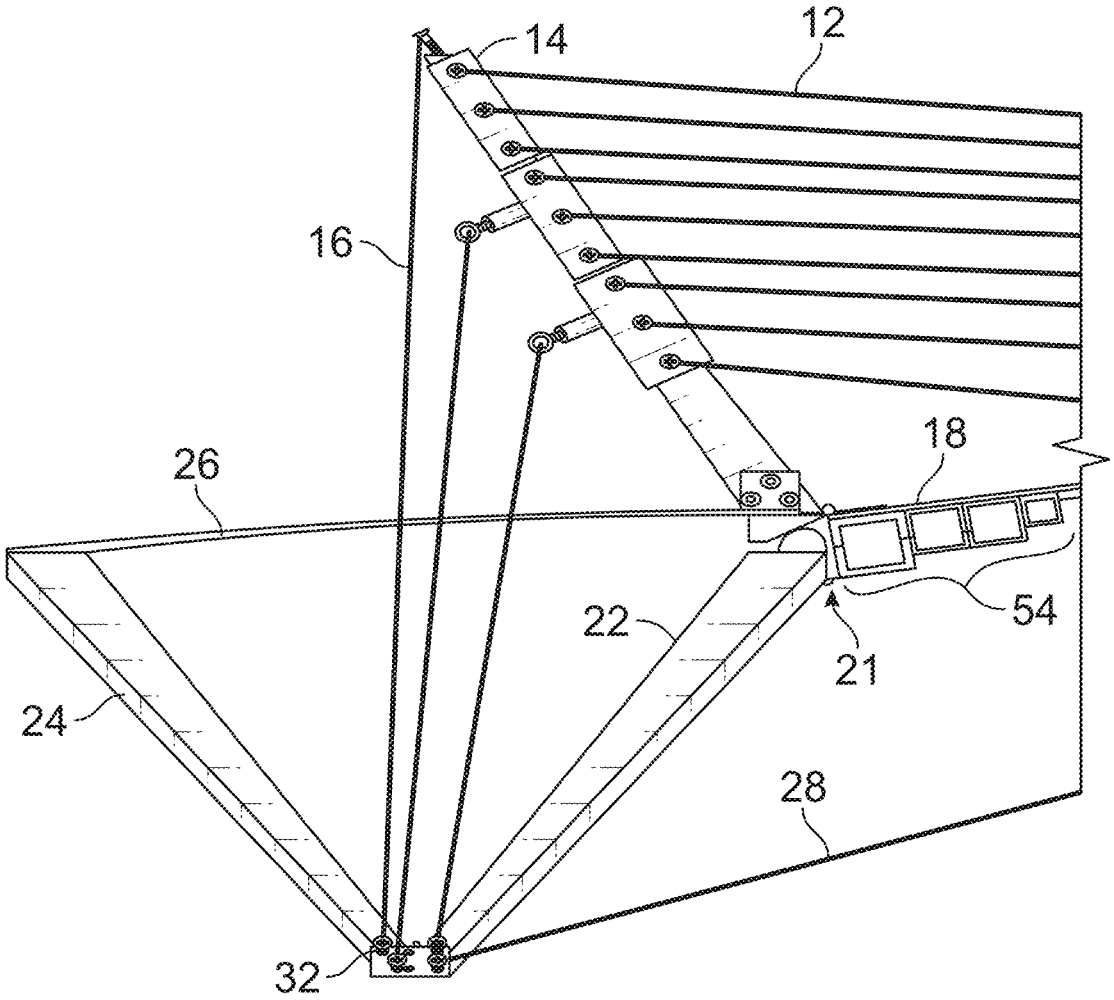
FIG. 11 illustrates a tower and approach detail view of the example bridge system shown in FIG. 9, in accordance with aspects of this disclosure.
Figure 12:
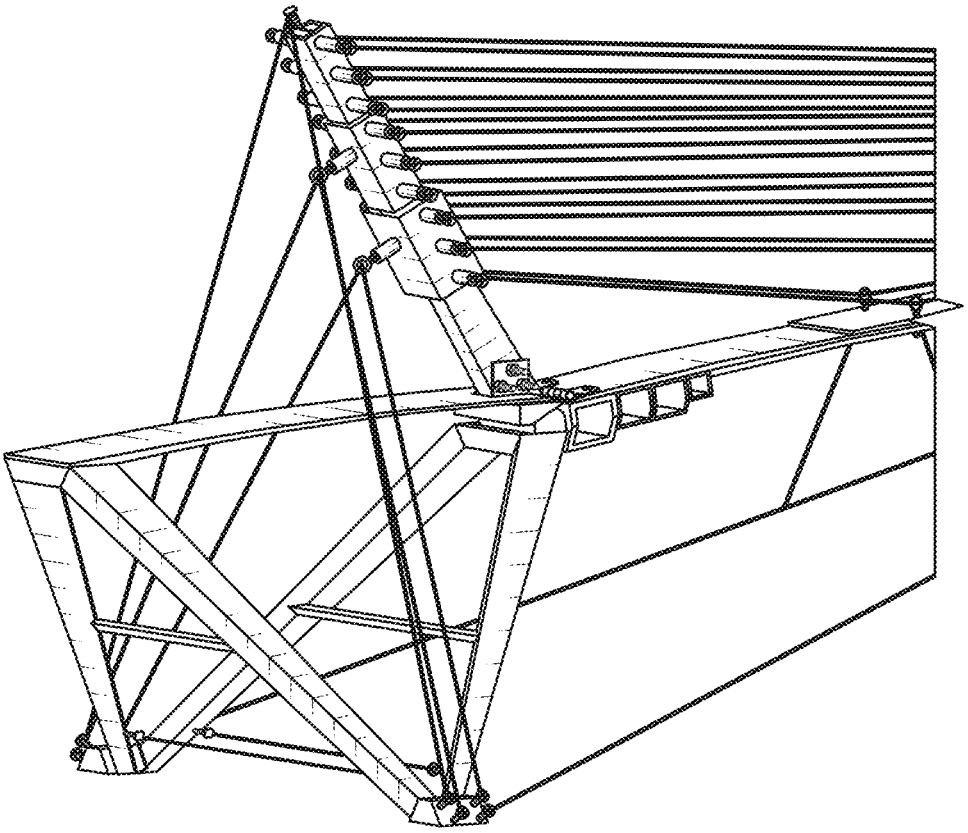
FIG. 12 illustrates a tower and approach detail of the example bridge system shown in FIG. 9, in accordance with aspects of this disclosure.

FIG. 11 illustrates a detailed side view of the approach 26 extending from a portion of a foundation or other structure (not shown) and onto the bridge deck 18. In some examples, the approach 26 is configured to shift into, away from, and/or laterally with respect to the bridge deck 18 in response to motion of the bridge. Further, in the example of FIG. 11, one or more tubes or blocks 54 are employed to distribute loads and/or support the bridge deck 18. The tubes 54 may take any suitable geometric shape (e.g., rectangular, circular, polygonal, etc.) or size or series of sizes, in examples employing multiple tubes or blocks. FIG. 12 illustrates a perspective view of the approach 26 shown in FIG. 11.

Figure 13:
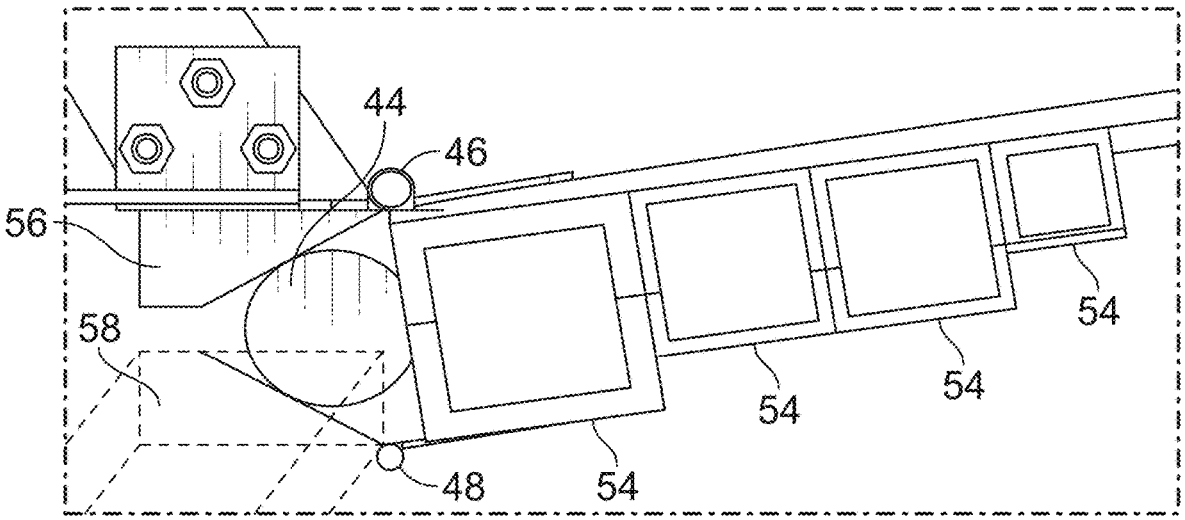
FIG. 13 illustrates a fulcrum detail of the example bridge system shown in FIG. 9, in accordance with aspects of this disclosure.
Figure 14:
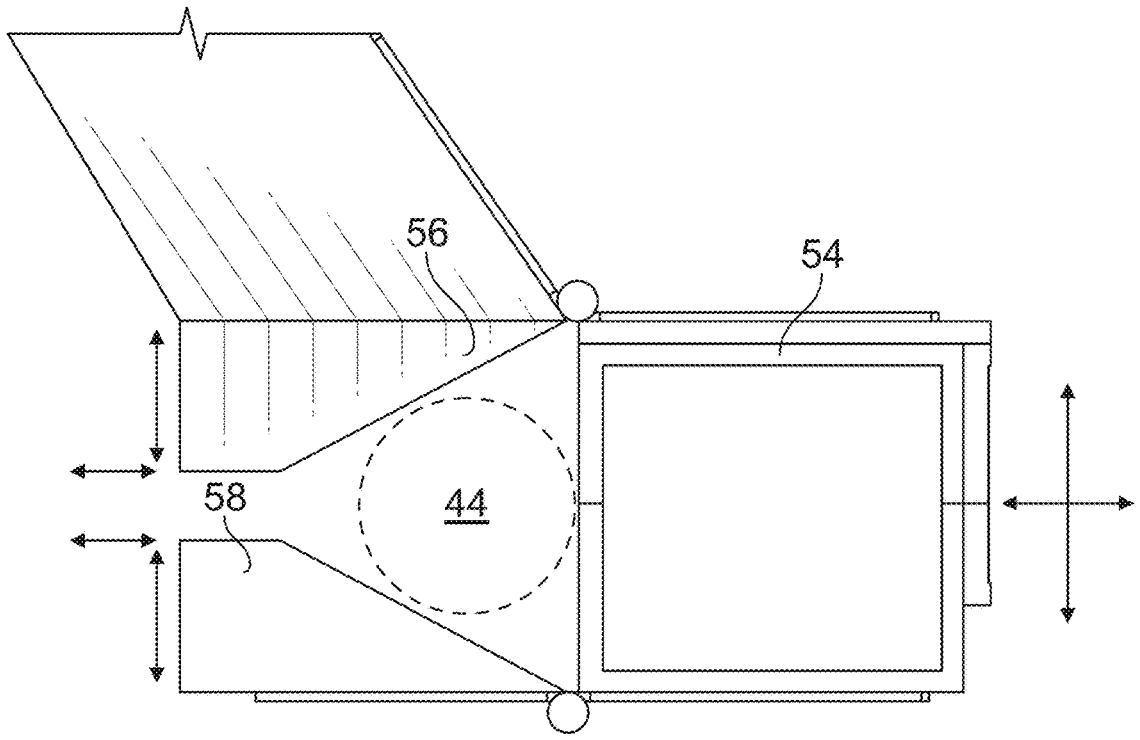
FIG. 14 illustrates fulcrum hinge(s) detail of the example bridge system shown in FIG. 9, in accordance with aspects of this disclosure.

FIGS. 13 and 14 illustrate detailed side views of the example fulcrum 21. Although FIG. 9 is illustrated with a fulcrum 21 different than fulcrum 20 illustrated with respect to FIGS. 1-8, either example bridge may use either fulcrum while employing the concepts disclosure herein, and benefiting from the advantages therefrom. As shown, a tower wedge 56 rests on element 44. A column wedge 58 lies beneath the element 44. Both tower and column wedges are secured to the bridge deck via one or more hinges, as disclosed herein. As shown, a tower hinge 46 is arranged to swing vertically around the hinge, such that the outward forces on the tower would result in compression of the element 44. Hinge 48 would support a substantial amount of weight and force from the bridge, and may therefore be a more robust hinge than hinge 46 (as shown in FIGS. 17 to 20).

Figure 15:
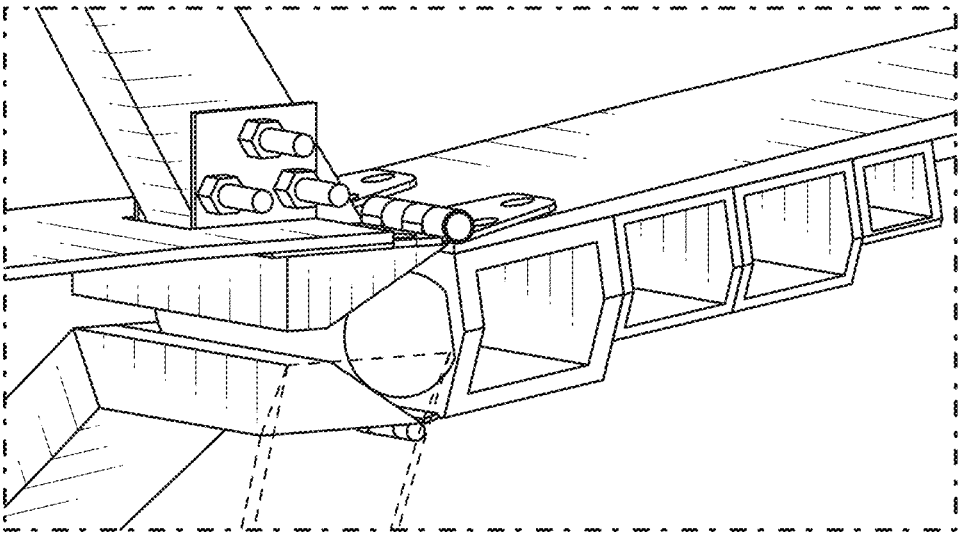
FIG. 15 illustrates a fulcrum detail of the example bridge system shown in FIG. 9, in accordance with aspects of this disclosure.
Figure 16:
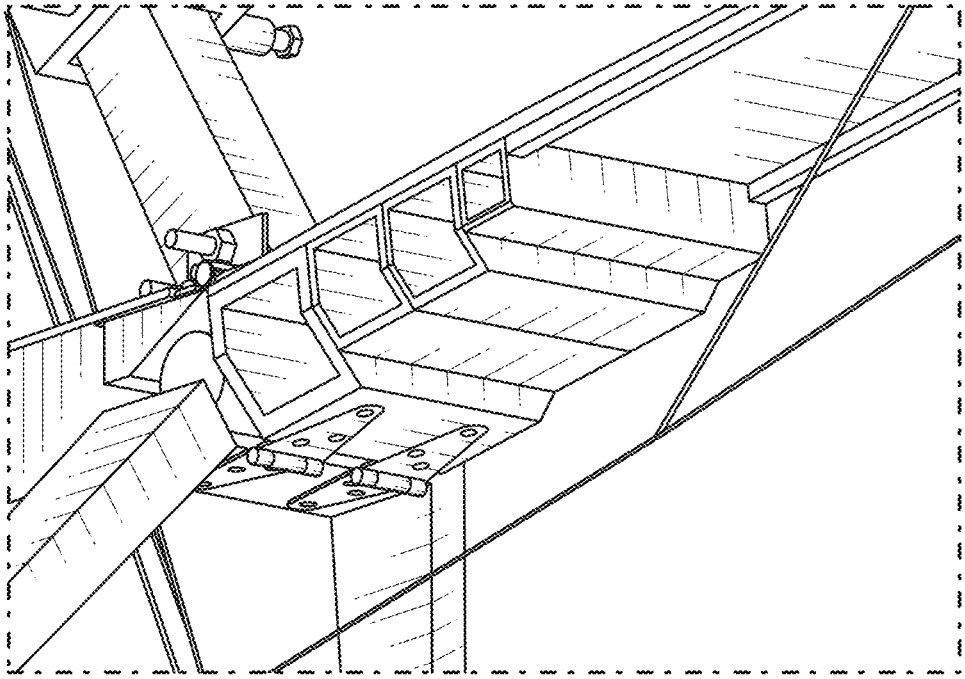
FIG. 16 illustrates another fulcrum detail of the example bridge system shown in FIG. 9, in accordance with aspects of this disclosure.
Figure 17:
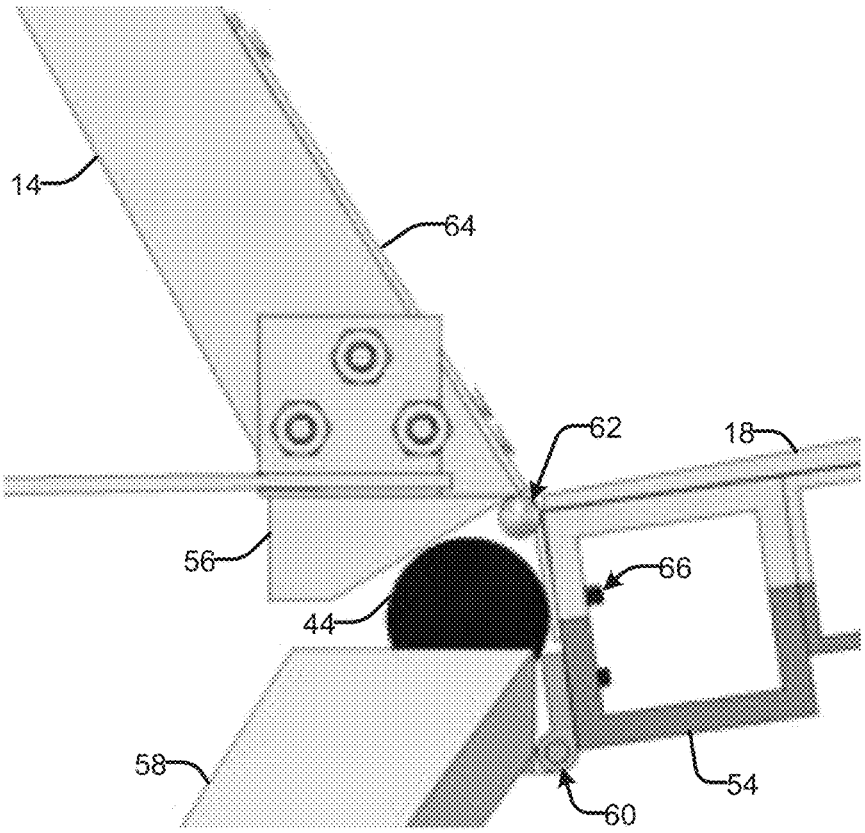
FIG. 17 illustrates another example fulcrum for an example bridge system, in accordance with aspects of this disclosure.
Figure 18:
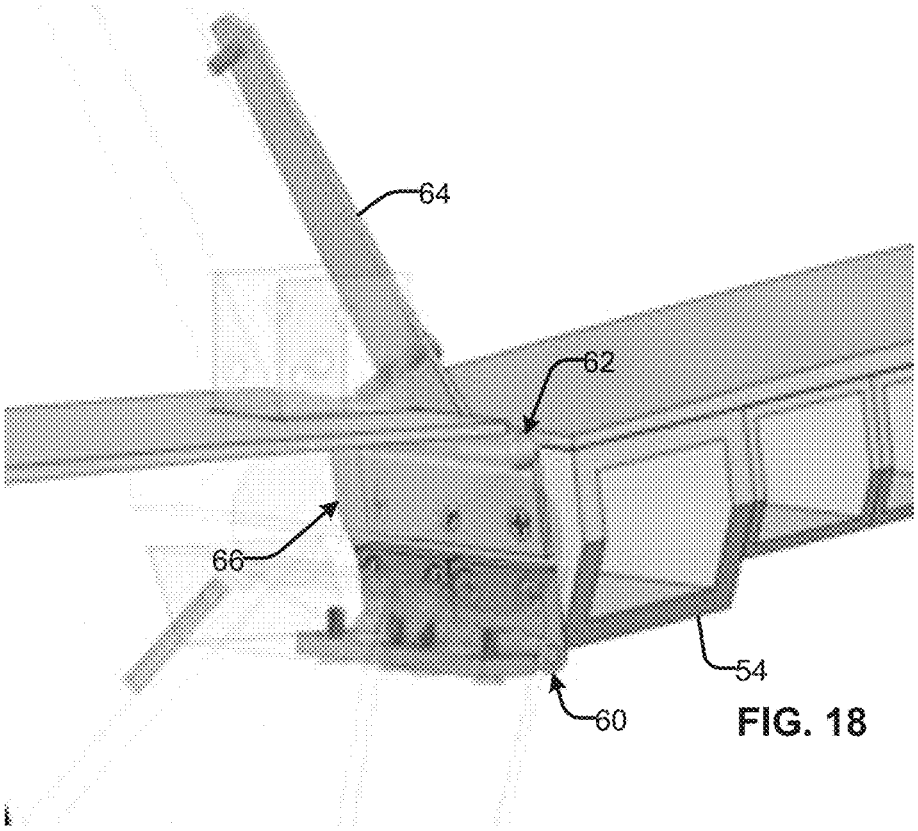
FIG. 18 illustrates fulcrum hinge(s) detail of the example fulcrum shown in FIG. 17, in accordance with aspects of this disclosure.
Figure 19:
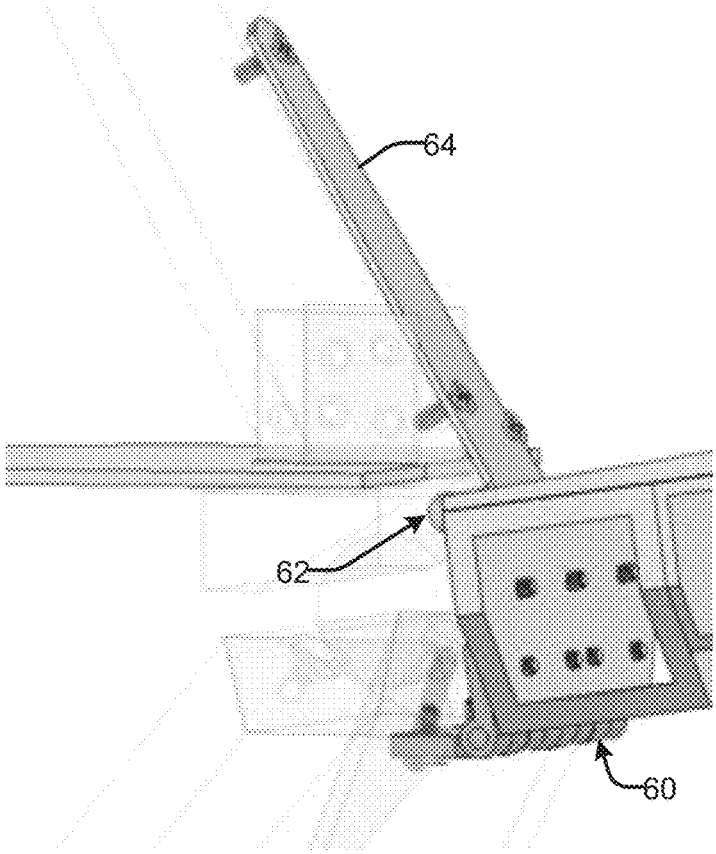
FIG. 19 illustrates a detailed view of the example fulcrum shown in FIG. 17, in accordance with aspects of this disclosure.
Figure 20:
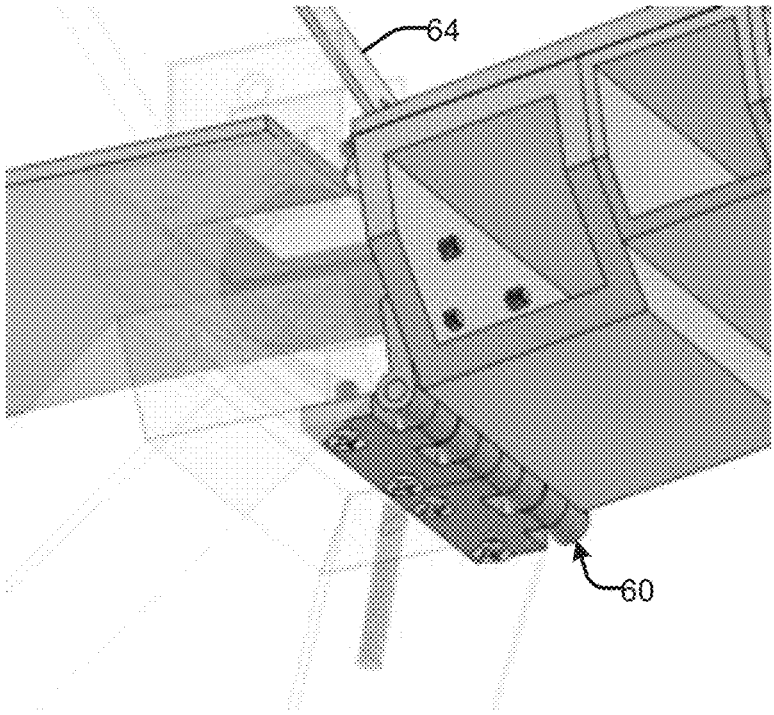
FIG. 20 illustrates another detailed view of the example fulcrum shown in FIG. 17, in accordance with aspects of this disclosure.

As shown in FIGS. 15 and 16, the first of the tubes 54 adjacent the fulcrum 21 may be larger than the tubes approaching the midpoint. Further, in some examples, tubes may be placed below the bridge deck 18 spanning the entire distance of the bridge deck 18, whereas in other examples the tubes 54 are provided at a limited distance from the fulcrum 21.

FIGS. 17 to 20 illustrate another example fulcrum shown with an alternative or additional hinge arrangement. As shown, a lower hinge 60 connects the tubes 54 to the columns 22 via column wedge 58. Opposite the hinge 60 is an upper hinge 62. As shown, the hinges 60 and 62 are secured to the tube 54 facing the element 44, which is different from the hinges 46 and 48 of FIGS. 13 to 16 secured to the top or bottom of tube 54, respectively. For example, an upper portion 64 of the hinge 62 is secured to the tower 14 (facing the bridge deck 18), whereas a lower portion 66 of the hinge 62 is secured to the tube 54 via one or more fasteners 66. Further, as the lower hinge 60 supports a greater portion of the load applied to the bridge system, the hinge 60 may be designed as a more robust hinge in comparison to hinge 62.

As disclosed with respect to the several drawings, the improved spanning bridge transfers forces across two or more load paths. The first load path includes transference of forces through the series of cables supporting the bridge. The second load path transfers forces through the shallow arch itself. A portion of the bridge deck's live and dead load flows along the arch to either end through the fulcrums, which adds redundancy during application of forces. Thus, if one or more of the upper cables are unable to effectively or efficiently transfer loads, the loads can follow the shallow arch bridge deck through to both ends.

In some examples, the disclosed spanning bridge may be constructed without towers (and/or with shorter towers). In some examples, the lower cables running under the bridge deck (which resolve the vertical upward force) can be eliminated, such as in applications where self-weight would obviate their need. The lower cables may also be eliminated where the counter force can be activated with alternative cable configurations, or by the use of an alternative force transfer mechanism.

In some examples, pre-stressing and/or recycling loads as disclosed herein may be applied to a bridge system without the use of upper cables. The forces would therefore be transferred through remaining or other cabling (e.g., vertical cables, lower cables, lateral cables, etc.), and/or one or more structural components (e.g., bridge deck, towers, columns, etc.).

In some examples, the disclosed spanning bridge can advantageously be provided as a system designed for straightforward deployment, and/or for quick assembly rather than following conventional bridge construction workflow. Assembly operations are typically carried out on firm ground, i.e., a solid foundation. The spanning bridge can be constructed and then lifted, rotated, telescoped, pulled, and/or pushed across to an opposite side an obstacle. In such an example, the assemblers are not exposed to danger by working out in the middle, with the assembly location at the main (or first) tower covered with a tent to protect against the elements. In some examples, where both sides of the bridge offers ready access and/or deployment speed is important, the bridge deck can be built from both ends and joined in the middle by a final, midsection bridge deck. Such an arrangement therefore allows a bridge to be erected which can accommodate significant traffic.

In some examples, no or a limited number of complex tools or heavy equipment are required for deployment, as the components fit together to lock into place, such as with pins or fasteners, when the system is put under stress. The forces resisted by such fasteners are often perpendicular so these fasteners are unlikely to loosen. Further, adjustments to the bridge during assembly can be carried out from firm ground.

Although illustrated with the lower cable spanning the bridge deck from one column to another and connected to the bridge deck via multiple stringers, in some examples an array of lower cables may be employed similar to the disclosed upper cable array. For instance, multiple fasteners may be arranged along a length of each column such that a given lower cable extends from a given column to be secured directly to the bridge deck, with a complimentary cable (or portion of the given lower cable) extending to and tensioned against an opposing column.

While the present method and/or system has been described with reference to certain embodiments, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

As used herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z".

As utilized herein, the terms "e.g.," and "for example" set off lists of one or more non-limiting examples, instances, or illustrations.

What is claimed is:

1. A bridge system configured to recycle loads on the bridge deck or superstructure though one or more structural elements, the bridge comprising:

first and second towers separated by a horizontal distance;

first and second columns each hinged to the first and second towers, respectively, at first and second fulcrums, respectively;

a bridge deck extending between the first and second fulcrums and secured thereto;

a plurality of upper cables each and extending between the towers and the bridge deck;

one or more lower cables extending between the first and second columns;

one or more stringer cables extending between the one or more lower cables and the bridge deck and secured thereto; and one or more vertical cables extending between the first tower and the first column.

2. The bridge defined in claim 1, wherein a first upper cable of the plurality of upper cables extends from a first tower fastener of the first tower to a first deck fastener arranged at a first portion of the bridge deck beyond a midpoint between the first and second fulcrums.

3. The bridge defined in claim 2, wherein a second upper cable of the plurality of upper cables extends from the first deck fastener to a second tower fastener of the second tower.

4. The bridge defined in claim 2, wherein the first tower further comprises a third tower fastener arranged below the first tower fastener along a length of the first tower, wherein a third upper cable of the plurality of upper cables extends from the third tower fastener to a second deck fastener of the one or more deck fasteners arranged at a second portion of the deck at or before the midpoint.

5. The bridge defined in claim 4, wherein a fourth upper cable of the plurality of upper cables extends from the second deck fastener to a fourth tower fastener of the second tower, wherein the fourth tower fastener is arranged above the second tower fastener along a length of the second tower.

6. The bridge defined in claim 1, wherein the one or more stringer cables are shortest at the midpoint and longest proximate the fulcrum.

7. The bridge defined in claim 1, further comprising one or more stringer fasteners to secure the one or more stringers to the bridge deck or the one or more lower cables.

8. The bridge defined in claim 2, further comprising one or more vertical tower fasteners arranged along a length of the first tower to tension the one or more vertical cables to one or more column fasteners of the first column.

9. The bridge defined in claim 2, further comprising one or more vertical tower fasteners arranged along a length of the second tower to tension the one or more vertical cables to one or more column fasteners of the second column.

10. The bridge defined in claim 1, wherein the first and second columns are anchored to a foundation or a fixed structure, wherein the first and second columns are anchored to the fixed structure via a hinged foundation connection, wherein the fixed structure is one of a geological structure, an embankment, a roadway, another bridge, concrete foundation, or a building.

11. The bridge defined in claim 1, wherein each fulcrum comprises a deformable or pivoting structure configured to compress or rotate in response to a force applied to the suspension bridge, wherein the deformable structure comprises a rubber material or a pivoting structure comprised of solid non deforming material, wherein the deformable structure is formed as a generally cylindrical tube or a solid pivoting structure that provides for rotation, wherein one or more of the bridge deck, the first or second towers, the first or second columns, or a combination thereof, are secured to the fulcrum via one or more hinges or functionally similar mechanisms that allow for movement.

12. The bridge defined in claim 1, wherein the first or second towers is oriented at obtuse angle relative to a horizontal plane between the first and second fulcrums.

13. The bridge defined in claim 1, wherein the first or second columns is oriented at obtuse angle relative to a horizontal plane between the first and second fulcrums.

14. The bridge defined in claim 1, further comprising an approach extending from a portion of the foundation to the bridge deck, wherein the approach is configured to shift into or away from the bridge deck in response to motion of the bridge.

15. The bridge defined in claim 1, wherein one or more of the tower fasteners, deck fasteners, column fasteners, or stinger fasteners is a bolt, an eyebolt ring, a screw, a rivet, a welded joint, a pulley, or a combination thereof.

16. The bridge defined in claim 1, wherein the bridge is comprised of a wooden material or a metallic material such as aluminum or steel.

17. The bridge defined in claim 1, wherein the bridge is comprised of a composite material or concrete in a range of compositions and reinforcements.

18. A bridge system configured to recycle loads on the bridge deck or superstructure though one or more structural elements, the bridge comprising:

first and second towers separated by a horizontal distance;

first and second columns each hinged to the first and second towers, respectively, at first and second fulcrums, respectively;

a bridge deck extending between the first and second fulcrums and secured thereto, wherein the bridge deck comprises a plurality of deck plates, each plate overlapping an adjacent deck plate along a length of the bridge deck between the first and second fulcrums, wherein a surface is typically overlayed on top of the bridge deck to support traffic;

a plurality of upper cables each and extending between the towers and the bridge deck;

one or more lower cables extending between the first and second columns;

one or more stringer cables extending between the one or more lower cables and the bridge deck and secured thereto; and one or more vertical cables extending between the first tower and the first column.

19. A bridge system configured to recycle loads on the bridge deck or superstructure though one or more structural elements, the bridge comprising:

first and second towers separated by a horizontal distance;

first and second columns each hinged to the first and second towers, respectively, at first and second fulcrums, respectively;

a plurality of upper cables each and extending between the towers and the bridge deck;

a bridge deck extending between the first and second fulcrums and secured thereto; and one or more vertical cables extending between the first tower and the first column.

20. The bridge defined in claim 19, further comprising:

one or more lower cables extending between the first and second columns; and one or more stringer cables extending between the one or more lower cables and the bridge deck and secured thereto.

* * * * *